US005228363A

United States Patent [19]

Corona et al.

[11] Patent Number: 5,228,363

[45] Date of Patent: Jul. 20, 1993

[54] HAND-HELD MULTIPLE OBJECT IMPLEMENT

[76] Inventors: Franco O. Corona; Antonio Corona, both of 175 Cumberland Street, Suite 1801, Toronto, Ontario, Canada, M5R 3M9

[21] Appl. No.: 773,859

[22] PCT Filed: Mar. 9, 1990

[86] PCT No.: PCT/CA90/00079

§ 371 Date: Oct. 17, 1991

§ 102(e) Date: Oct. 17, 1991

[87] PCT Pub. No.: WO90/10524

PCT Pub. Date: Sep. 20, 1990

[30] Foreign Application Priority Data

Mar. 10, 1989 [GB] United Kingdom ..... 8905548

[51] Int. Cl.[5] ..... B25B 23/00

[52] U.S. Cl. ..... 81/439; 81/490; 81/177.4

[58] Field of Search ..... 81/439, 490, 177.4

[56] References Cited

U.S. PATENT DOCUMENTS 1,579,498 4/1926 Anderson .
4,463,788 8/1984 Corona et al. .
4,552,043 11/1985 Corona et al. .
4,552,044 11/1985 Corona et al. .
4,762,036 8/1988 Orlitzky et al. .

FOREIGN PATENT DOCUMENTS 2408434 4/1977 France .
2408434 2/1978 France .
2437370 2/1978 France .

*Primary Examiner*—James G. Smith

*Attorney, Agent, or Firm*—Fay, Sharpe, Beall, Fagan, Minnich & McKee

[57] ABSTRACT

In a hand held multiple bit object implement having a handle with a central longitudinal axis, a bit selector cup rotatably mounted at an end of said handle to rotate about said central axis, a plurality of bits provided peripherally of said handle in a generally circular pattern about said handle axis, each bit being provided in said handle to extent essentially parallel to said handle's axis, a chuck provided at said end of said handle, said chuck being aligned with said handle axis for receiving a bit head, said cup having a continuous side wall with an interior surface spaced radially outwardly of the radial location of said circular pattern of bits and a closed cup end, an elongate slot extending from a central portion of said cup end and radially outwardly to the location of said bits in said handle, said cup being rotatable to position said slot in register with any desired bit in said handle, said slot in said cup being of sufficient size to permit withdrawal of a bit shaft from said handle in a direction generally parallel with said handle axis, said slot defining opposing cup slot wall portions along the length of the slot, said bit head having a plurality of outwardly projecting external faces portions of which contact said cup slot wall portions to retain said bit within said cup, said bit being movable along said slot towards said cup center into alignment with said chuck for insertion of said bit head into said chuck, the improvement comprising a locking unit mounted within an end of said cup having a slot formed therewith corresponding to the shape and size of the slot in the cup end, said locking unit being provided with a generally U-shaped internal sleeve extending through the cup and toward the chuck, said internal sleeve being provided with hexagonal faces adapted to cooperatively engage the faces of bit heads for guiding the head toward a chuck.

11 Claims, 3 Drawing Sheets 10
12
14
16
17
18
20
30
46
52
56
58

HAND-HELD MULTIPLE OBJECT IMPLEMENT

TECHNICAL FIELD

This invention relates to hand held implements incorporating multiple objects, and more particularly to screwdrivers with interchangeable bits which are captured within the screwdriver.

BACKGROUND ART

Examples of known prior art hand held multiple object implements are disclosed in Applicant's corresponding issued U.S. Pat. Nos. 4,552,043; 4,552,044; 4,463,788; 4,716,795 and 4,716,796. These patents teach the use of a hand held implement comprising a handle with a central longitudinal axis, a selector cup rotatably mounted at an end of the handle to rotate about the central axis and a plurality of objects (e.g. bits) provided peripherally of the handle in a generally cylindrical pattern about the handle axis. Each bit is of hexagonal cross-section and oriented in the handle to extend essentially parallel to the handle axis. A chuck is provided at the end of the handle where the chuck is aligned with the handle axis for receiving a bit end and securing it against rotation. An elongate slot extends from a central portion of the cup end and radially outwardly to the location of the bits in the handle. The cup is rotatable to position the slot in register with any desired bit in the handle. The slot in the cup has walls sufficiently spaced apart to permit outward withdrawal through the slot of a bit shaft from the handle in a direction generally parallel with the handle axis. Means is provided for retaining the selected tool bit in the cup. The bit end is movable along the slot towards the cup centre into alignment with the chuck for insertion of the bit end in the chuck. The handle has a plurality of channels for receiving a corresponding plurality of bits. Each of the channels has means for cooperating with the respective bit to maintain a predetermined alignment of the bit within the handle as the bit is withdrawn therefrom.

DISCLOSURE OF INVENTION

According to an aspect of the present invention, each bit is of generally circular cross-section having a hexagonal bit head portion adapted to engage with corresponding hexagonal wall portions of the aforementioned channels.

Furthermore, in accordance with the present invention the aforementioned means provided for retaining the selected tool bit in the cup comprises a locking unit rotatably mounted within an end of the cup. The locking unit has a slot formed therein corresponding to the shape and size of the slot in the cup end. The unit is provided with a generally U-shaped internal sleeve extending through the cup and toward the chuck. The internal sleeve is provided with hexagonal faces adapted to receive the bit head and engage the corresponding hexagonal faces of the bit head for guiding the head toward the chuck.

As discussed, the locking unit is rotatable such that upon insertion of the bit head into the chuck, the unit and internal sleeve forming part thereof may be rotated relative to the stationary hexagonal chuck such that the hexagonal faces of the internal sleeve are offset from the corresponding faces of the bit head. As a result, the respective hexagonal faces of the internal sleeve and bit head are no longer in alignment such that portions of the hexagonal bit head which overlap respective faces of the internal sleeve function to prevent removal of the bit head from the chuck when the implement is in use.

BRIEF DESCRIPTION OF DRAWINGS

A preferred embodiment of the invention will be described with reference to the following drawings, in which.

BEST MODE OF CARRYING OUT THE INVENTION

Figures 1, 2, 3, 4, 5:
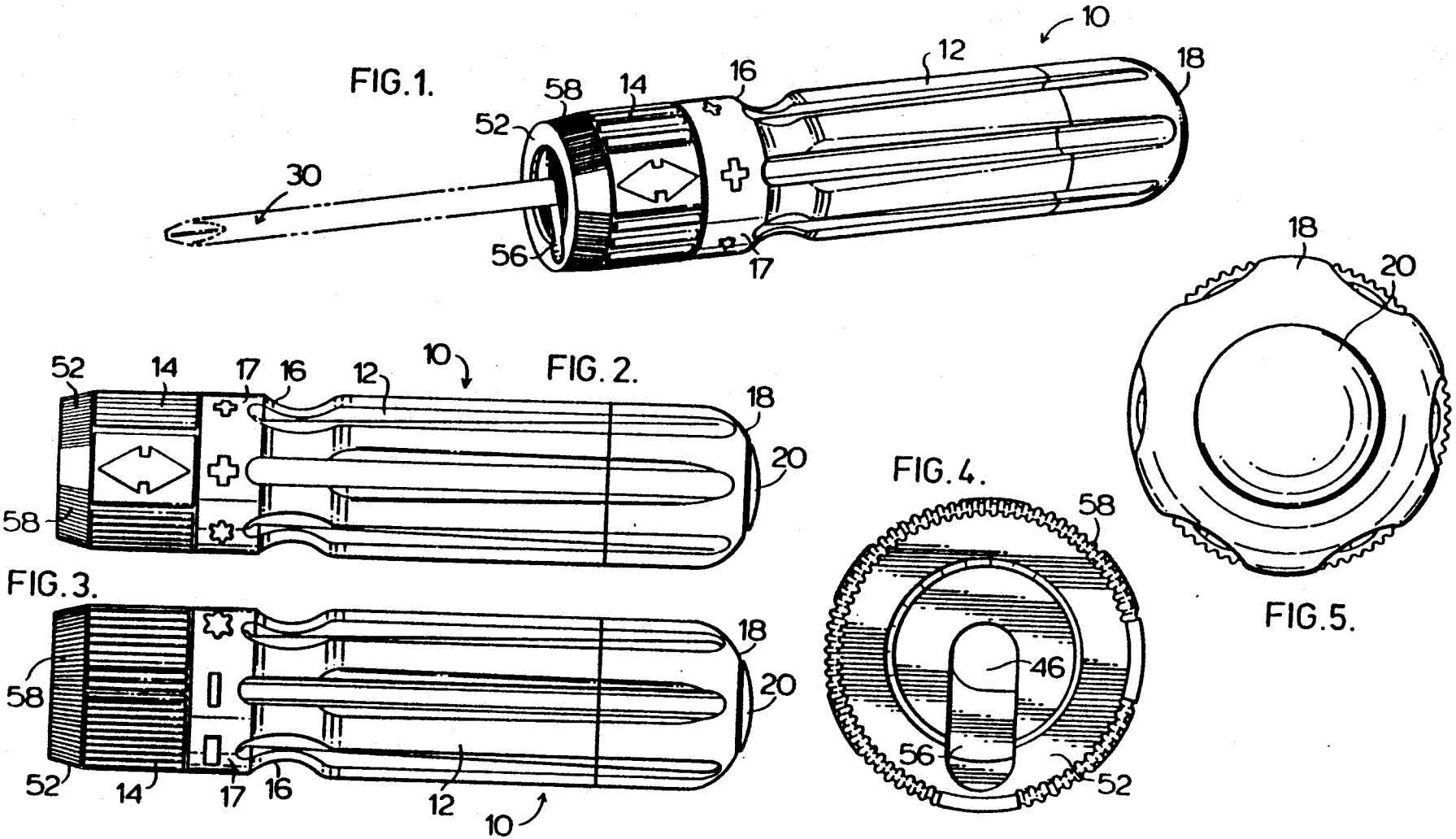
FIG. 1 is a perspective view of a hand held multiple object implement in accordance with the present invention.
FIG. 2 is a front elevation view of the implement in FIG. 1.
FIG. 3 is a rear elevation view of the implement in FIG. 1.
FIG. 4 is a left side view of the implement in FIG. 1.
FIG. 5 is a right side view of the implement of FIG. 1.
Figure 6:
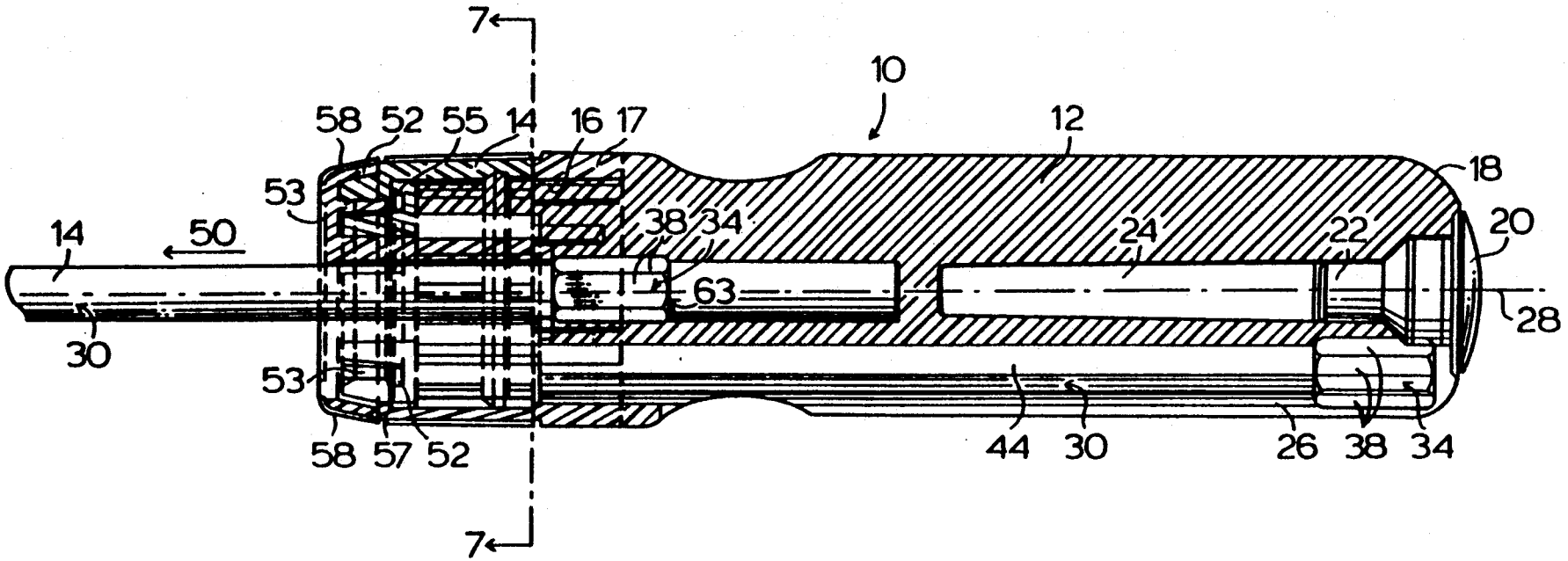
FIG. 6 is a cross-sectional view of the implement in FIG. 1.

Turning to FIGS. 1–6, the multi-object device 10 comprises a handle portion 12 with a rotatable bit selector cup 14 mounted at the bottom end 16 of the handle. Enclosing the top end 18 of the handle is a cap 20 having a stub portion 22 which is secured in the circular cavity 24. It is appreciated that the lid 20 may be permanently secured to seal off the cavity 24, or a releasable catch may be used between the stub 22 and the cavity wall to permit removal of the cap 20 to provide for storage of various items in cavity 24. Furthermore, the outside surface of cap 20 may include means for attaching loops, cords, etc. thereto, or alternatively may be used for displaying a logo or other personalization symbol.

A symbols ring 17 carries visual indication of the shape of object or bit 30 stored within respective ones of the channels 26. The ring 17 is preferably a secondary component which may be easily interchangeable during manufacturing to accommodate a multiplicity of combinations of different shaped objects or bits 30. Furthermore, by providing the ring 17 as a separate component from the remainder of handle portion 12, manufacture of a new ring with symbols required to designate additional applications (e.g. cosmetic sticks, etc.) does not require creation of a new mold for the handle but merely a mold for the ring itself.

The handle 12 has a plurality of channels 26 provided therein, all of which extend in the direction parallel to the longitudinal axis 28 of the handle. The channels 26 are arranged generally in a circular pattern about the central axis 28 of the handle. The channels provide a bit magazine within the handle for the plurality of bits to be carried by the handle. According to this particular embodiment, six channels are provided about the perimeter of the handle to thereby provide six different shapes of objects 30 (e.g. bits) for selective use with the device.

It is contemplated that the device of the present invention may be used for storing and selectively retrieving a diverse selection of objects, such as bits in a multi-bit screwdriver, or even cosmetic sticks in a portable make-up unit.

Each channel 26 is hexagon-shaped to receive the corresponding hexagon shape of the enlarged bit head 34. Thus, the channel has a plurality of recesses in the form of internal faces to receive the corresponding outwardly projecting external faces 38 of the hexagonal bit head 34. The upper body of the handle 12 includes an opening up one of the recessed faces to the peripheral portion of the handle to provide thereby openings which expose the shaft portion 44 of the bit.

The rotatable selector cup 14 has an elongate slot 46 (FIGS. 4 and 7B) provided in the cup lower wall. The slot is aligned with the selected bit shaft 44 to permit outward withdrawal of the bit 30 from the channels 26 in the direction of arrow 50.

According to an improved aspect of the present invention over Applicant's prior art screwdriver, a locking unit 52 is rotatably mounted to the cup 14 by means of an annular ridge 53 extending into a correspondingly shaped groove 55 of the cup 14. The ridge has a lip portion 57 for securing engagement within the groove 55. The locking unit 52 has a slot 56 formed therein corresponding to the shape and size of the slot 46 in the cup end. The locking unit 52 is provided about its periphery with ridges 58 adapted for easy handling and rotation thereof relative to the cup 14.

Locking unit 52 is shown in greater detail with reference to FIGS. 8A, 8B, 9 and 10 comprising an internal sleeve portion 60 of generally U-shape and having internal hexagonal faces 62 adapted to cooperatively engage the faces 38 of bit head 34.

In operation, the slot 46 of cup 14 is first aligned with a predetermined one of the channels 26 to allow the working end of the selected bit 30 to be moved out of the handle 12. The locking unit 52 is then rotated to the open position (FIG. 7A) such that slots 56 and 46 are aligned. Next, the bit 30 is withdrawn from channel 26 into the cup 14 until overhanging (i.e. triangular extension) portions of the hexagonal bit head 34 come into contact and abut the aforementioned lower wall of the cup 14.

With the bit head 34 free of channel 26, the bit 30 is slid along aligned slots 56 and 46 so as to cooperatively engage internal walls 62 of the sleeve 60.

Figure 7B:
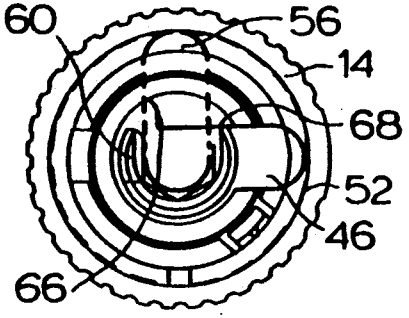
FIGS. 7A and 7B are end views of the cup, locking unit and internal sleeve viewed along the lines 7—7 in FIG. 6, in open and locked positions respectively.
Figure 7A:
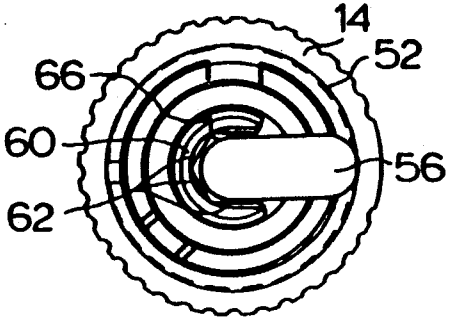
Figure 9:
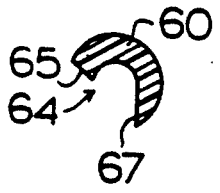
FIG. 9 is a cross-sectional view along the lines 9—9 in FIG. 8A.
Figure 8A:
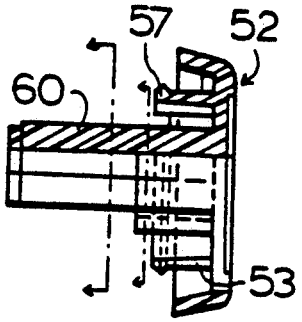
FIGS. 8A and 8B are left and right side cross-sectional views of the locking unit incorporating an internal sleeve.
Figure 10:
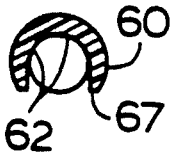
FIG. 10 is a cross-sectional view along the lines 10—10 in FIG. 8A.
Figure 8B:
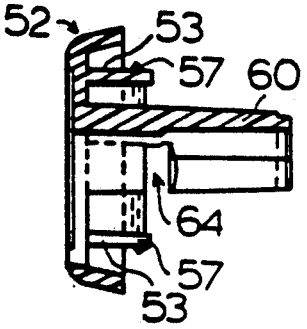

As shown in FIGS. 8B and 9, a portion of the internal sleeve 60 is cut away to form a recess or slot 64 bounded by a wall 65 which abuts against a corresponding wall 66 in the cup lower wall of the selector cup 14 when in the open position of FIG. 7A.

However, upon rotating the locking unit 90° to the position shown in FIG. 7B, an edge 67 of the internal sleeve 60 contacts another region 68 of the wall 66 of cup 14, thereby preventing any further rotation of the locking unit 52 relative to the cup 14.

In the open position as shown in FIG. 7A, the walls 62 of internal sleeve 60 are aligned with corresponding walls (not shown) of the chuck 63, as well as the corresponding walls 38 of bit head 34.

The bit head 34 is then inserted into the chuck 63 for secure engagement therewithin. Preferably a magnet is located at the bottom of the chuck 63 for attracting the bit head 34 thereto.

Finally, the locking unit 52 is rotated to the position shown in FIG. 7B such that the hexagonal faces 62 of internal sleeve 60 are offset by 90° from the corresponding faces 38 of bit head 34. Accordingly, bit head 34 is prevented from being removed from the chuck 63 as a result of overhanging (i.e. triangular extension) portions of the hexagonal faces 38 abutting the now opposing faces 62 of the internal sleeve 60. In this way, the selected bit 30 is secured within the chuck 63.

INDUSTRIAL APPLICABILITY

The improved locking unit 52 of the present invention allows for the use of cylindrical shank bits as opposed to prior art bits having generally oblong cross section as taught by Applicant's U.S. Pat. No. 4,552,044. Manufacture of such circular cross section bits is substantially less expensive than prior art oblong-shaped bits. Furthermore, the shape of the circular bits used in accordance with the present invention are more pleasing aesthetically than the prior art oblong-shaped bits.

Other embodiments and variations of the invention are possible. All such embodiments and variations are believed to be within the sphere and scope of the present invention as defined by the claims hereto.

The embodiments of the invention in which an exclusive property or privilege is claimed are defined as follows:

1. A hand held multiple object implement (10) having a handle (12) with a central longitudinal axis (28), a bit selector cup (14) rotatably mounted at an end (16) of said handle to rotate about said central axis, a plurality of bits (30) provided peripherally of said handle in a generally circular pattern about said handle axis, each bit being provided in said handle to extend essentially parallel to said handle's axis, a chuck (63) provided at said end of said handle, said chuck being aligned with said handle axis for receiving a bit head (34) and securing it against rotation, said cup having a continuous side wall with an interior surface spaced radially outwardly of the radial location of said circular pattern of bits and a closed cup end, an elongate slot (46) extending from a central portion of said cup end and radially outwardly to the location of said bits in said handle, said cup being rotatable to position said slot in register with any desired bit in said handle, said slot in said cup being of sufficient width and length to permit outward withdrawal of a bit shaft from said handle in a direction generally parallel with said handle axis, said slot defining opposing cup slot wall portions along the length of the slot, said bit head (34) having a plurality of outwardly projecting external faces (38) overhanging portions of which contact said opposing cup slot wall portions, said bit head retaining said bit within said cup, said bit being movable along said slot towards said cup centre into alignment with said chuck for insertion of said bit head into said chuck, THE IMPROVEMENT COMPRISING a locking unit (52) mounted within an end of the cup, said locking unit having a slot (56) formed therewithin corresponding to the shape and size of the slot (46) in the cup end, said locking unit being provided with a generally U-shaped internal sleeve (60) extending through the cup and toward the chuck, said internal sleeve being provided with hexagonal faces (62) adapted to cooperatively engage the faces (38) of bit head (34) for guiding the head toward a chuck, further comprising means for rotating said locking unit such that upon insertion of the bit head into the chuck, said unit and internal sleeve forming part thereof may be rotated relative to the stationary chuck such that the hexagonal faces of the internal sleeve are offset from the corresponding faces of the bit head, whereby the respective hexagonal faces of the internal sleeve and bit head are no longer in alignment such that portions of the hexagonal bit head which overlap respective faces of the internal sleeve function to prevent removal of the bit head from the chuck when the implement is in use.

2. The implement of claim 1 further comprising an annular ridge (53) extending from said locking unit into a correspondingly shaped groove (55) of the cup, said ridge being provided with a lip portion (57) for securing engagement within the groove.

3. The implement of claim 1 wherein a portion of said internal sleeve is cut away forming a recess (64) bounded by a wall (65) which abuts against a corresponding wall (66) in the lower wall of the selector cup when in a open position.

4. The implement of claim 3 wherein said internal sleeve further comprises an edge (67) which contacts a further region (68) of the wall of the selector cup, thereby preventing any further rotation of the locking unit relative to the cup.

5. The implement of claim 1, further comprising a cap (20) having a stub portion (22) which is secured in a circular cavity (24) of the handle into which various items may be placed for storage.

6. The implement of claim 5, wherein an outside surface of said cap includes means for attaching one of either a loop or cord thereto.

7. The implement of claim 6, wherein an outside surface of said cap incorporates one of either a logo or personalization symbol.

8. The implement of claim 1, further comprising a symbols ring (17) on said handle, said ring incorporating a visual indication of the shape of each of the bits provided peripherally within said handle, said ring being provided as a separate interchangeable component from said handle.

9. The implement of claim 1, wherein said locking unit further comprises a plurality of ridges (58) on the periphery thereof, said ridges being adapted for easy handling and rotation of said locking unit relative to the cup.

10. The implement of claim 1, further comprising a magnet located at the bottom of the chuck for attracting and securing the bit head thereto.

11. The implement of claim 1, wherein each of said plurality of bits comprises a cylindrical shank connected to said hexagonal bit head.

* * * * *